US009449463B2

(12) United States Patent
Walker

(10) Patent No.: US 9,449,463 B2
(45) Date of Patent: Sep. 20, 2016

(54) METHOD OF GAMING, A GAMING SYSTEM AND A GAME CONTROLLER

(71) Applicant: Aristocrat Technologies Australia Pty Limited, North Ryde (AU)

(72) Inventor: Peter Leslie Walker, Marsfield (AU)

(73) Assignee: Aristocrat Technologies Australia Pty Limited (AU)

( * ) Notice: Subject to any disclaimer, the term of this patent is extended or adjusted under 35 U.S.C. 154(b) by 112 days.

(21) Appl. No.: 14/243,188

(22) Filed: Apr. 2, 2014

(65) Prior Publication Data

US 2014/0295953 A1 Oct. 2, 2014

(30) Foreign Application Priority Data

Apr. 2, 2013 (AU) ..... 2013901122

(51) Int. Cl.
*A63F 9/00* (2006.01)
*G07F 17/32* (2006.01)

(52) U.S. Cl.
CPC ..... *G07F 17/3258* (2013.01)

(58) Field of Classification Search
None
See application file for complete search history.

(56) References Cited

U.S. PATENT DOCUMENTS 5,707,287 A * 1/1998 McCrea, Jr. ..... A63F 1/12 273/292
6,234,895 B1 5/2001 Jones et al.
6,276,683 B1 8/2001 Such
6,336,859 B2 1/2002 Jones et al.
6,485,368 B2 11/2002 Jones et al.
8,147,324 B2 4/2012 Mothwurf et al.
2001/0024969 A1 9/2001 Jones et al.
2002/0077168 A1 6/2002 Jones et al.
2003/0069059 A1* 4/2003 Stanek ..... A63F 3/081 463/17
2004/0224750 A1* 11/2004 Al-Ziyoud ..... G07F 17/32 463/17
2005/0070356 A1 3/2005 Mothwurf et al.
2007/0270205 A1* 11/2007 Al-Ziyoud ..... G07F 17/32 463/18
2008/0153587 A1 6/2008 Yoshimura
2008/0261683 A1* 10/2008 Russell ..... G07F 17/32 463/26
2009/0124314 A1* 5/2009 Halligan ..... G07F 17/322 463/13
2009/0131161 A1 5/2009 Lim et al.
2009/0181766 A1 7/2009 Tsukahara (Continued)

FOREIGN PATENT DOCUMENTS

AU 2004224937 A1 5/2005
AU 2009238326 A1 12/2009

(Continued)

*Primary Examiner* — Seng H Lim
(74) *Attorney, Agent, or Firm* — McAndrews, Held & Malloy, Ltd.

(57) ABSTRACT

A gaming system comprises a display controlled by the gaming system to display a prior jackpot value of a jackpot corresponding to a value of the jackpot when a previous jackpot trigger event occurred. The gaming system is arranged to receive wagers on one or more games playable in the gaming system, increment a current value of the jackpot pool in memory of the gaming system based on the wagers, determine a jackpot event value of the jackpot responsive to a jackpot event occurring, the jackpot event value being the current value of the jackpot upon the jackpot event occurring and the jackpot event being independent of incrementing the jackpot, upon the player winning the jackpot responsive to the jackpot event, make an award to the player of the jackpot event value, and upon the player not winning the jackpot responsive to the jackpot event, set the jackpot event value as a new prior jackpot value and control the display to display the new prior jackpot value until the next jackpot event.

16 Claims, 7 Drawing Sheets

(56) References Cited

U.S. PATENT DOCUMENTS

| | | | | |
|---|---|---|---|---|
| 2009/0209329 | A1 | 8/2009 | Soukup | |
| 2009/0209330 | A1 | 8/2009 | Soukup | |
| 2009/0209331 | A1 | 8/2009 | Soukup | |
| 2009/0209332 | A1 | 8/2009 | Soukup | |
| 2009/0247273 | A1 | 10/2009 | Bramble | |
| 2011/0086700 | A1* | 4/2011 | Walker | G07F 17/3258 463/27 |
| 2011/0130191 | A1 | 6/2011 | Englmann et al. | |
| 2013/0172076 | A1* | 7/2013 | Bramble | G07F 17/3258 463/27 |

FOREIGN PATENT DOCUMENTS

| | | | |
|---|---|---|---|
| AU | 2004224937 | B2 | 7/2011 |
| AU | 2009238326 | B2 | 1/2012 |
| AU | 2012200378 | A1 | 2/2012 |
| JP | 2000140243 | A | 5/2000 |
| JP | 2007054187 | A | 3/2007 |
| JP | 2007117762 | A | 5/2007 |
| JP | 2007117764 | A | 5/2007 |
| JP | 2007125319 | A | 5/2007 |
| JP | 2007125320 | A | 5/2007 |
| JP | 2008054952 | A | 3/2008 |
| JP | 2009090133 | A | 4/2009 |
| JP | 4425933 | B2 | 3/2010 |
| JP | 4425935 | B2 | 3/2010 |
| JP | 2010154997 | A | 7/2010 |
| JP | 4528708 | B2 | 8/2010 |
| JP | 2010227346 | A | 10/2010 |
| JP | 2011189164 | A | 9/2011 |
| JP | 4787599 | B2 | 10/2011 |
| JP | 2011235160 | A | 11/2011 |
| JP | 2011235161 | A | 11/2011 |
| NZ | 518209 | A | 9/2004 |
| WO | 03067534 | A1 | 8/2003 |

* cited by examiner

METHOD OF GAMING, A GAMING SYSTEM AND A GAME CONTROLLER

RELATED APPLICATIONS

This application claims priority to Australian Provisional Patent Application No. 2013901122 having a filing date of Apr. 2, 2013, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

Gaming systems are known in which an incrementing jackpot can be won by a player. For example, in a progressive jackpot where the value of the jackpot increases until the prize is won. Implementations are know where jackpots are made available in respect of play of an individual electronic gaming machine or in respect of play of one of a plurality of electronic gaming machines that are linked together to a common jackpot controller.

The incrementing value of the jackpot is typically based on turnover and is displayed to the player or players either on the player's electronic gaming machine or on a common display.

While such gaming systems provide players with enjoyment, a need exists for alternative gaming systems in order to maintain or increase player enjoyment.

BRIEF SUMMARY OF THE INVENTION

In a first aspect, the invention provides a method of gaming in a gaming system, the method comprising:

displaying a prior jackpot value of a jackpot on a display of the gaming system, the prior jackpot value corresponding to a value of the jackpot when a previous jackpot trigger event occurred, receiving wagers on one or more games playable in the gaming system;

incrementing a current value of the jackpot pool in memory of the gaming system based on the wagers;

determining a jackpot event value of the jackpot responsive to a jackpot event occurring, the jackpot event value being the current value of the jackpot upon the jackpot event occurring and the jackpot event being independent of incrementing the jackpot;

upon the player winning the jackpot responsive to the jackpot event, making an award to the player of the jackpot event value; and upon the player not winning the jackpot responsive to the jackpot event, setting the jackpot event value as a new prior jackpot value and displaying the new prior jackpot value until the next jackpot event.

In an embodiment, the method comprises conducting a determination responsive to the jackpot event to determine whether to award the jackpot to the player.

In an embodiment, the method comprises displaying the jackpot event value of the jackpot before conducting the determination.

In a second aspect, the invention provides a method of gaming in a gaming system, the method comprising:

displaying an initial jackpot value of a jackpot, receiving wagers on one or more games playable in the gaming system;

incrementing a current value of the jackpot pool in memory of the gaming based on the wagers;

determining a jackpot event value of the jackpot responsive to a jackpot event occurring, the jackpot event value being the current value of the jackpot upon the jackpot event occurring and the jackpot event being independent of incrementing the jackpot;

upon the player winning the jackpot responsive to the jackpot event, making an award to the player of the jackpot event value of the jackpot pool; and upon the player not winning the jackpot responsive to the jackpot event, continuing to display the initial jackpot value.

In an embodiment, the method comprises conducting a determination responsive to the jackpot event to determine whether to award the jackpot to the player.

In a third aspect, the invention provides a gaming system comprising a display controlled by the gaming system to display a prior jackpot value of a jackpot corresponding to a value of the jackpot when a previous jackpot trigger event occurred, the gaming system arranged to:

receive wagers on one or more games playable in the gaming system;

increment a current value of the jackpot pool in memory of the gaming system based on the wagers;

determine a jackpot event value of the jackpot responsive to a jackpot event occurring, the jackpot event value being the current value of the jackpot upon the jackpot event occurring and the jackpot event being independent of incrementing the jackpot;

upon the player winning the jackpot responsive to the jackpot event, make an award to the player of the jackpot event value; and upon the player not winning the jackpot responsive to the jackpot event, set the jackpot event value as a new prior jackpot value and control the display to display the new prior jackpot value until the next jackpot event.

In an embodiment, the gaming system is arranged to conduct a determination responsive to the jackpot event to determine whether to award the jackpot to the player.

In an embodiment, the gaming system is arranged to control the display to display the jackpot event value of the jackpot before conducting the determination.

In an embodiment, the gaming system is a standalone gaming machine and a game controller of the gaming machine maintains the current jackpot value.

In an embodiment, the gaming system comprises a plurality of gaming machines linked to a jackpot controller that maintains the current jackpot value.

In a fourth aspect, the invention provides a gaming system comprising a display controlled by the gaming system to display an initial jackpot value of a jackpot, the gaming system arranged to:

receive wagers on one or more games playable in the gaming system;

increment a current value of the jackpot pool in memory of the gaming system based on the wagers;

determine a jackpot event value of the jackpot responsive to a jackpot event occurring, the jackpot event value being the current value of the jackpot upon the jackpot event occurring and the jackpot event being independent of incrementing the jackpot;

upon the player winning the jackpot responsive to the jackpot event, make an award to the player of the jackpot event value of the jackpot pool; and upon the player not winning the jackpot responsive to the jackpot event, control the display to continue to display the initial jackpot value.

In an embodiment, the gaming system is arranged to conduct a determination responsive to the jackpot event to determine whether to award the jackpot to the player.

In an embodiment, the gaming system is a standalone gaming machine and a game controller of the gaming machine maintains the current jackpot value.

In an embodiment, the gaming system comprises a plurality of gaming machines linked to a jackpot controller that maintains the current jackpot value.

In a fifth aspect, the invention provides computer program code which when executed implements the above method.

In a sixth aspect, the invention provides a tangible computer readable medium comprising the above program code.

BRIEF DESCRIPTION OF SEVERAL VIEWS OF THE DRAWINGS

An exemplary embodiment of the invention will now be described with reference to the accompanying drawings in which.

DETAILED DESCRIPTION OF THE INVENTION

Figure 1:
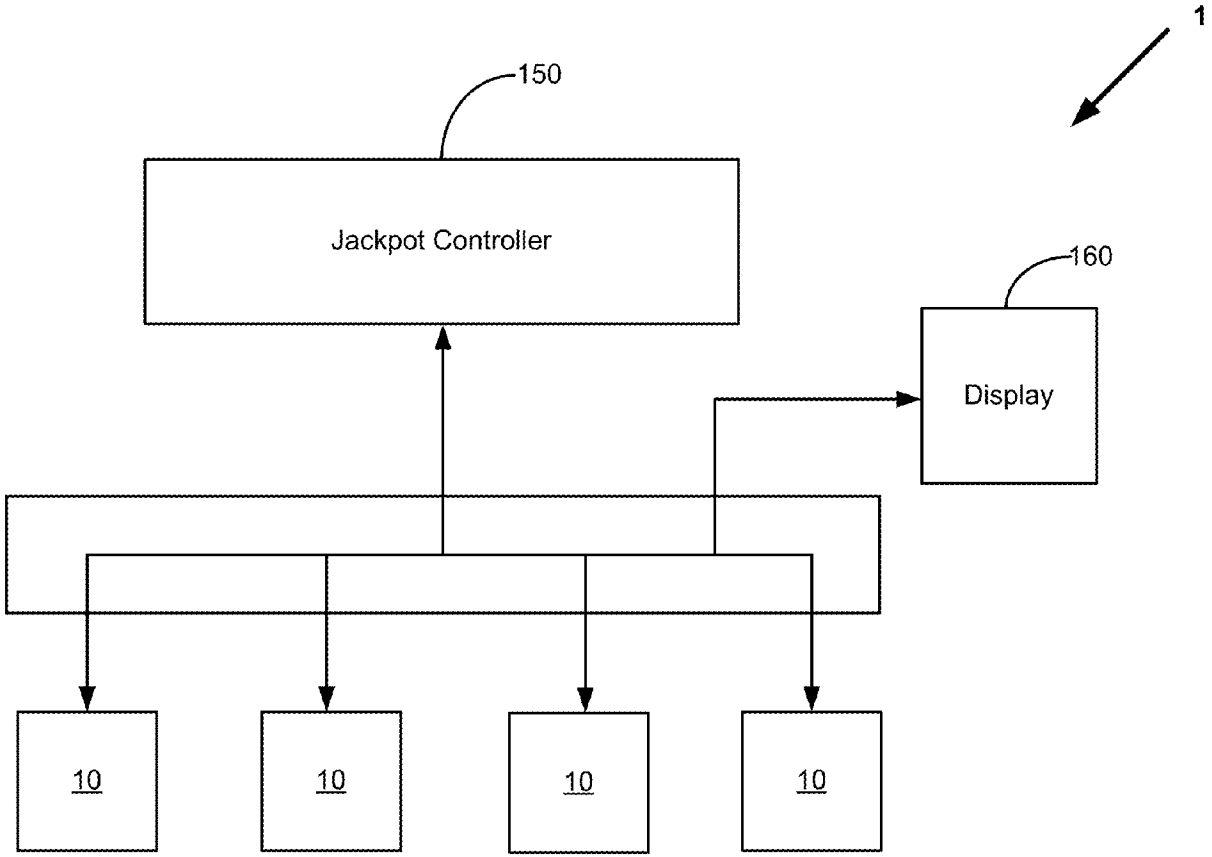
FIG. 1 is a block diagram of the core components of a gaming system.

Referring to the drawings, there is shown a gaming system having a game controller arranged to implement methods of incrementing and displaying a jackpot. In one embodiment, the gaming system is arranged to increment the jackpot in the background and only updates the displayed jackpot when a jackpot event occurs that provides the player with the opportunity to win and the player fails to win the jackpot.

General Construction of Gaming System

A gaming system can take a number of different forms to provide play of one or more games. In a first form, standalone gaming machines are provided wherein all or most components required for implementing the game are present in a player operable gaming machine.

In a second form, often referred to as server based gaming, a distributed architecture is employed wherein some of the components required for implementing the game are present in a player operable gaming machine and some of the components required for implementing the game are located remotely relative to the gaming machine with which the player interacts. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in standalone gaming machine mode, "thick client" mode or "thin client" mode depending on the game being played, operating conditions, and so on. Other variations will be apparent to persons skilled in the art.

Further, it may be desired for the gaming system to allow a player to engage in some element of game play with other players—for example in a linked game, a community game or a jackpot. Or it may be desired to allow other components to communicate with the player such as a loyalty or bonusing system. In such a system, the gaming system may have a number of gaming machines playable by different players.

Irrespective of the form, the portion of gaming system for providing play of a game to a player has several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface and typically includes a processor 62 that processes the game play instructions in accordance with game play rules and outputs game play outcomes to the display. Typically, the game play rules are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
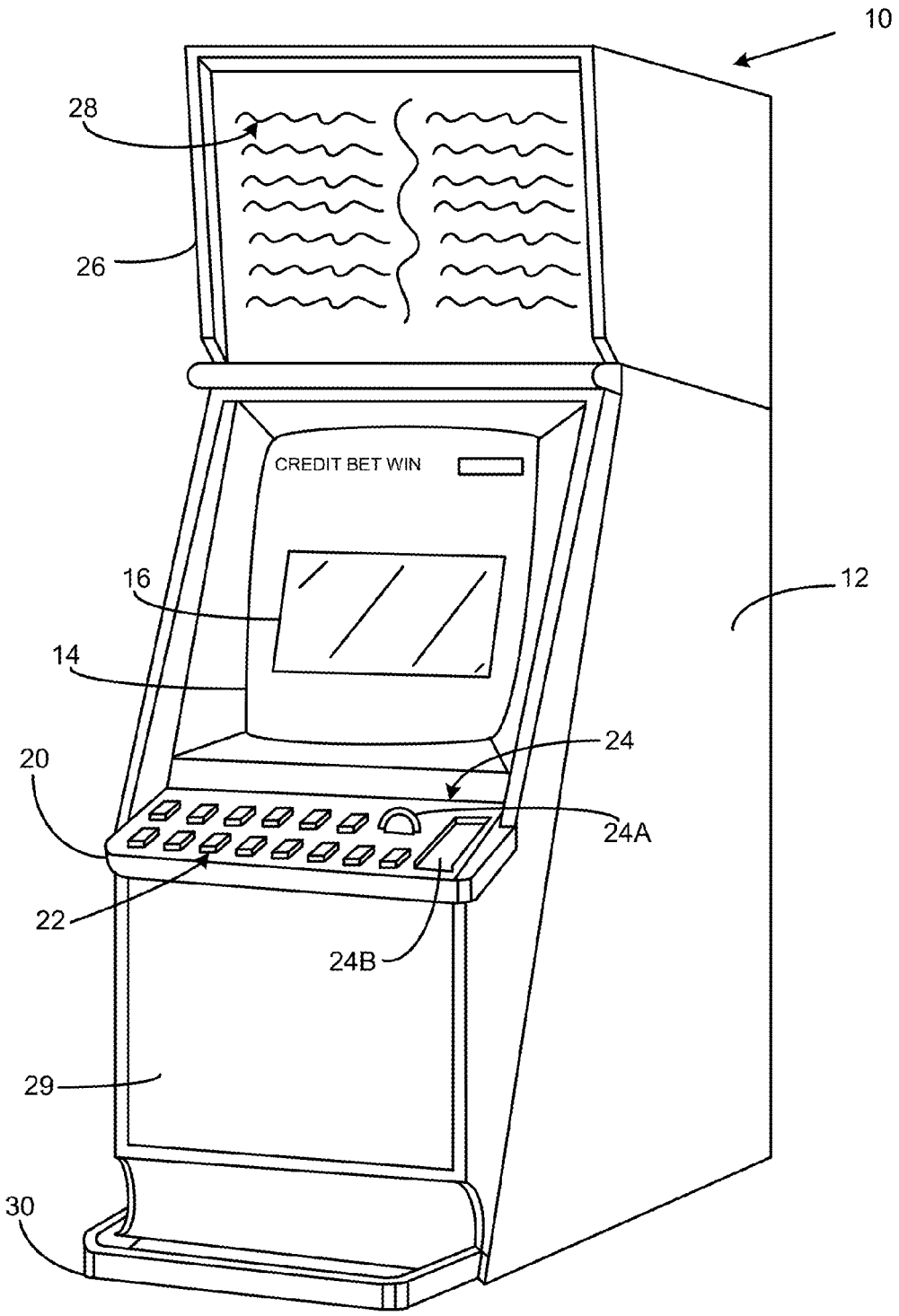
FIG. 2 is a perspective view of a stand alone gaming machine.

A gaming system in the form of a standalone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. Other gaming machines may configure for ticket in such that they have a ticket reader for reading tickets having a value and crediting the player based on the face value of the ticker. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
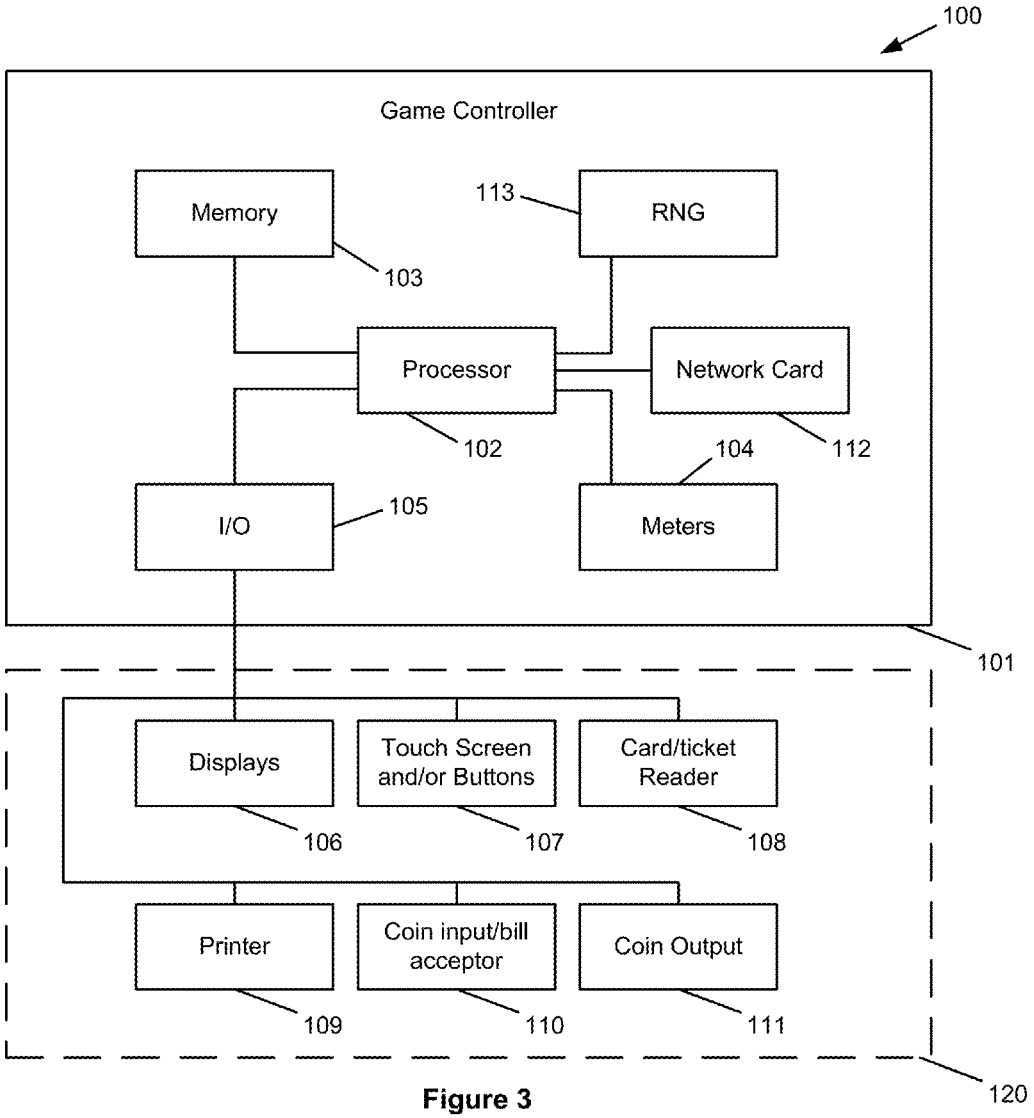
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
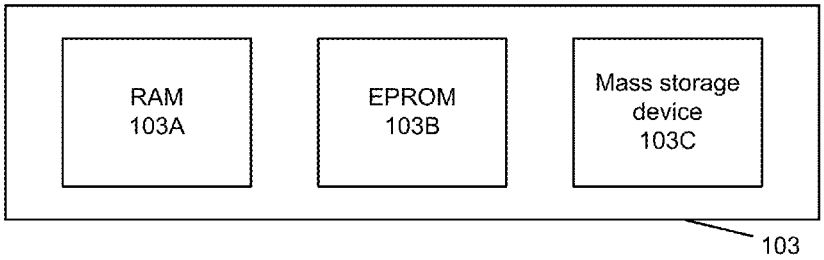
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
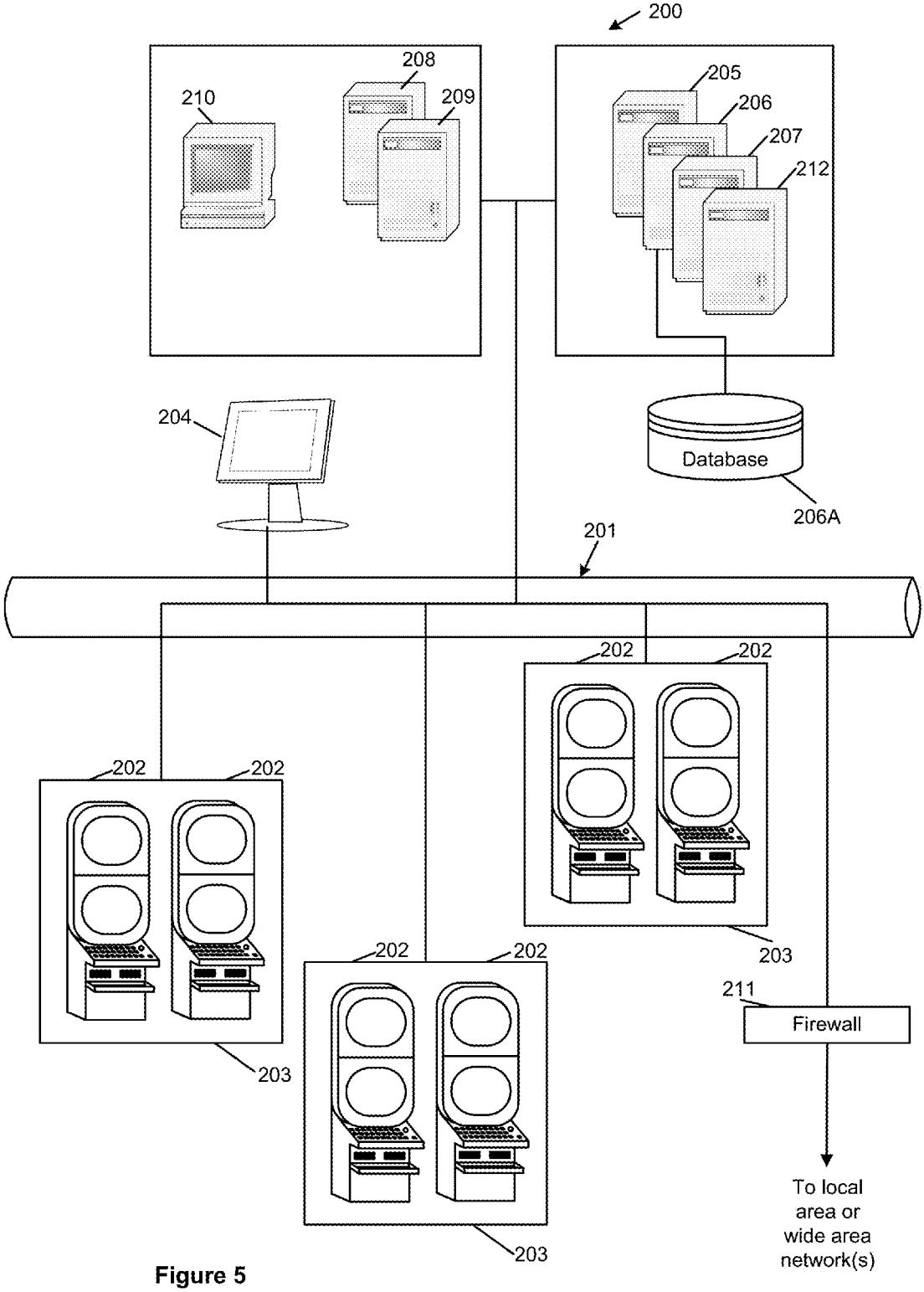
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3. That is, the gaming machines may act as standalone gaming machines for most aspects of game play but be networked so they can participate in the jackpot. In other embodiments, the gaming machines may be server based gaming devices. In further embodiments, there may be a mixture of standalone gaming machines and server based gaming devices. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202 such as a current value of a jackpot, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. The Jackpot controller 207 is provided to perform accounting functions for the Jackpot game (but in other embodiments, the jackpot controller may implement a jackpot game). A loyalty program server 212 may also be provided. Persons skilled in the art will also appreciate that a jackpot controller may be linked to a single bank of, for example, 4 to 8 gaming machines (such that the jackpot controller is dedicated to the bank) and that a controller linked to a single bank of gaming machines may control a linked game accessible by gaming machines of the bank. In still further embodiments, there may be plural levels of jackpots controlled by different jackpot controllers. For example a first level associated with a specific bank of machines and a second level associated with all the gaming machines of a venue.

In a thin client embodiment, a game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming System

In the embodiment shown in FIG. 1, the gaming system 1 comprises a bank of four gaming machines 10 and a jackpot controller 150. The jackpot controller is linked to a display 160 that displays a jackpot prize value.

The games played on the individual gaming machines 10 may be spinning reel games. In most spinning reel games, it is typical for the player to place a wager by selecting combinations of display positions to wager upon and an amount to wager per selection. For example, a player may select how many lines they play in each game—e.g. a minimum of one line up to the maximum number of lines allowed by the game (noting that not all permutations of win lines may be available for selection) and how much they wager per line. Such win lines are typically formed by a combination of symbol display positions, one from each reel, the symbol display positions being located relative to one another such that they form a line.

In other games, the player may select a number of reels to play and an amount to wager per reel. Such games are marketed under the trade name "Reel Power" by Aristocrat Leisure Industries Pty Ltd. The selection of the reel means that each displayed symbol of the reel can be substituted for a symbol at one or more designated display positions. In other words, all symbols displayed at symbol display positions corresponding to a selected reel can be used to form symbol combinations with symbols displayed at a designated, symbol display positions of the other reels. For example, if there are five reels and three symbol display positions for each reel such that the symbol display positions comprise three rows of five symbol display positions, the symbols displayed in the centre row are used for non-selected reels. As a result, the total number of ways to win is determined by multiplying the number of active display positions of each reel, the active display positions being all display positions of each selected reel and the designated display position of the non-selected reels. As a result for five reels and fifteen display positions there are 243 ways to win.

In one embodiment, an outcome of the game (such as a specific combination of symbols) may provide a jackpot event where the player has a chance to win a jackpot prize. For example, if the selected symbols include a defined number of scatter symbols (scatter symbols being symbols that do not have to appear at display positions selected by the player).

Persons skilled in the art will appreciate that the jackpot event may trigger a feature game and the jackpot may be awarded by means of the feature game. A feature game involves some additional element of game play which usually only occurs when a trigger condition is met. Types of feature games include: those where a series of free game events are awarded such as free games or re-spins (where some reels are held while others are re-spun); games where the symbols on the reel are changed; and "second screen" games where game play is totally different to the base game, for example where the player makes selections in a "pick a box type" game.

Each gaming machine 10 also determine whether to award a prize, for example, by comparing selected symbols to a defined pay table. As is the case in some gaming machines, the player may be provided with the opportunity to gamble any winnings that result from play of the game before initiating a new play of the game.

In the embodiment, the jackpot events are events which occur on the gaming machines 10 and the gaming machines 10 themselves determine whether an award is to be made of a jackpot. For example, if the player achieves a particular outcome, such as selecting a matching pair of boxes in a pick a box game. However, in other embodiments, the jackpot controller 150 may conduct the jackpot game. For example, a jackpot event on an individual gaming machine may establish eligibility for the player to play a jackpot game controlled by the jackpot controller and displayed on display 160.

The jackpot controller of the embodiment is arranged to maintain a jackpot by incrementing the jackpot value based on increments transmitted to the jackpot controller 150 by the gaming machines 10.

Figure 6:
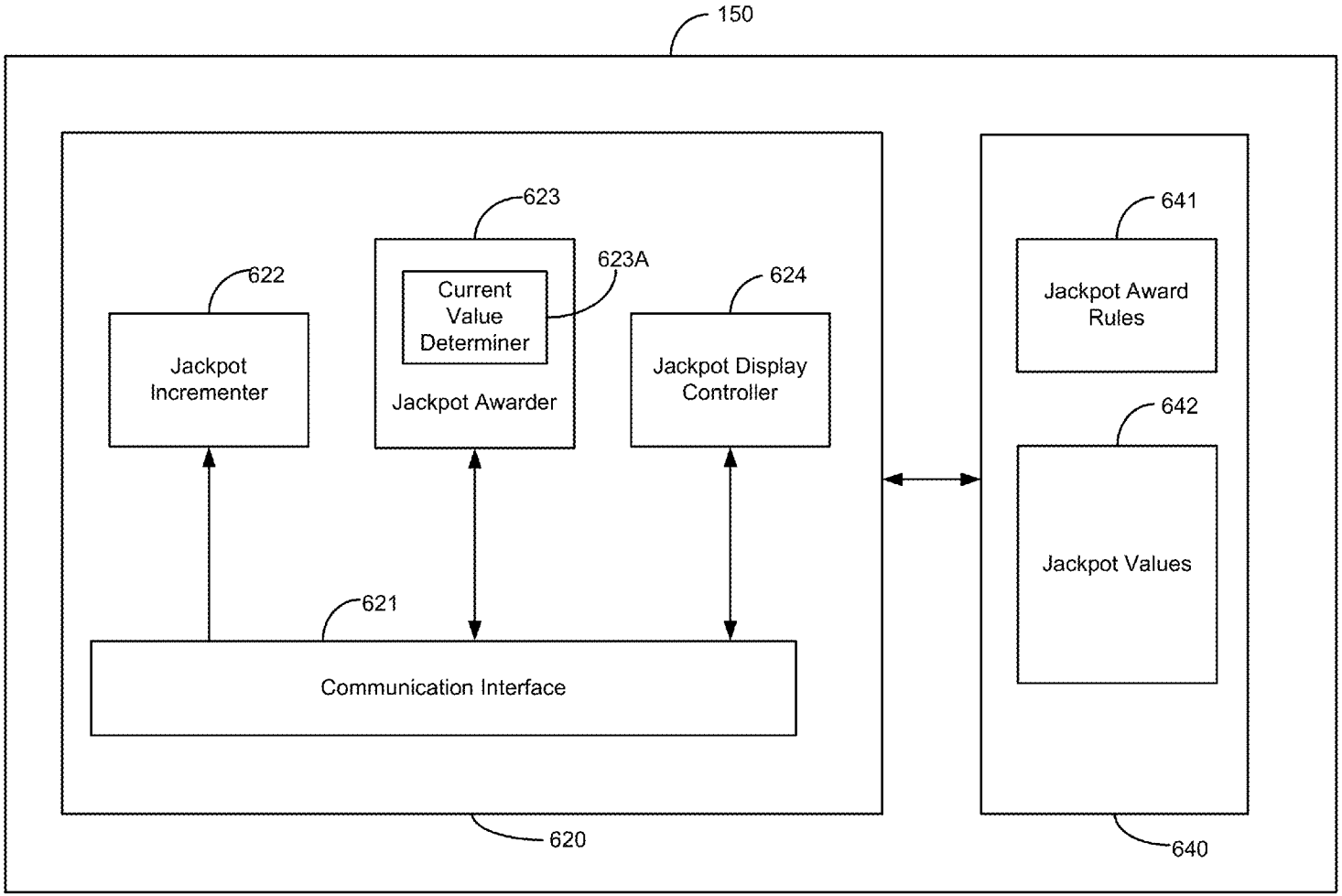
FIG. 6 is a further block diagram of a gaming system.

In this respect, as shown in FIG. 6, the jackpot controller 150 includes a communication interface 621 which receive the increments communicated by the gaming machines 10. The increments are passed to a jackpot incrementer 622 which increments a current value of the jackpot which is stored as one of the jackpot values 642 in memory 640. The jackpot values 642 that are stored will depend of the jackpot award rules 641, and two examples of jackpot values that may be stored are given in relation to the description of FIGS. 7 and 8.

The jackpot controller 150 also includes a jackpot awarder 623. The jackpot awarder includes current value determiner 623A which determines the current value of the jackpot in response to a jackpot event occurring. The jackpot event value defines the amount that can be awarded to the player should they subsequently receive a jackpot award. In some embodiments, the jackpot event will indicate that the gaming machine being played by the player is about to determine whether the player should win the jackpot award. If the jackpot is won, the jackpot awarder 623 communicates via communication interface 621, the amount of the jackpot award as defined by the jackpot event value. This enables the gaming machine 10, for example, to add this amount to the credit meter. In other embodiments, it may be necessary for the jackpot to be paid manually. In other embodiments, the jackpot event may be merely the award of the jackpot because a condition has occurred in respect of the gaming machine that results in the award being made (for example, a specific symbol combination).

In another embodiment, the jackpot may be provided to the player by the printing of a ticket through a ticket printer located at the gaming machine 10 that the player can use to redeem the jackpot award.

It will be appreciated from the above description that the jackpot incrementer 622 and jackpot awarder 623 are modules implemented by a processor 620 of jackpot controller 150 and that the jackpot award rules 641 and jackpot value 642 are respectively stored as data in a memory 640 of the jackpot controller. Another module of the jackpot controller is a jackpot display controller 624 which communicates via communication interface 621 with a display 160 in order to control the jackpot value that is displayed on display 160. The jackpot value that is displayed is not the current value of the jackpot, unless the jackpot value has just been updated for example, where it has been updated in accordance with the jackpot incrementing techniques described below, or where it has been reset, for example, following a jackpot win.

Figure 7:
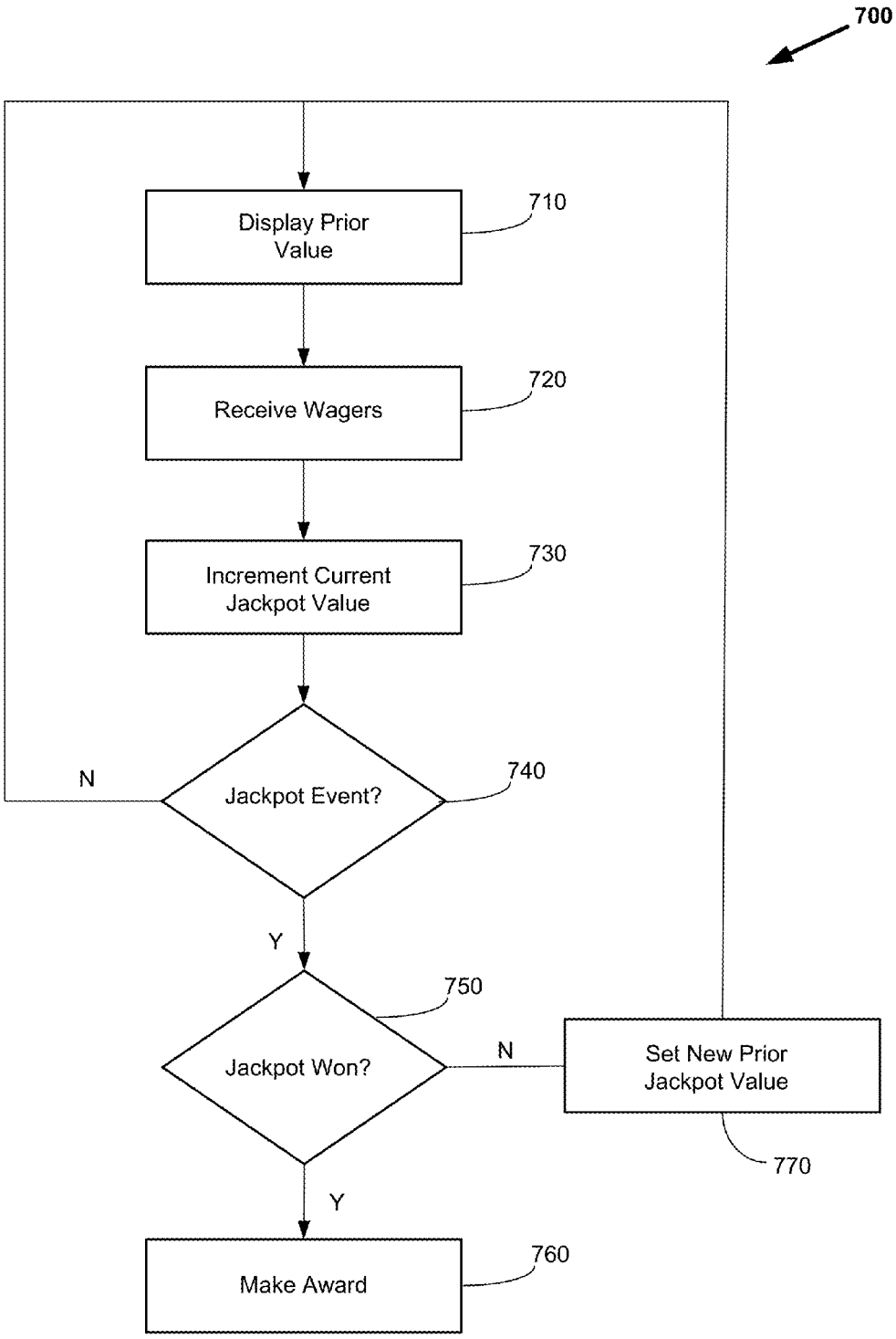
FIG. 7 is a flow chart of an embodiment.

Referring to FIG. 7, there is shown a jackpot incrementing technique of an embodiment. In this embodiment, the method 700 involves displaying a prior value of the jackpot 710 which may either be the initial value of the jackpot or value corresponding to a prior update. The method 700 involves receiving wagers at each of the gaming machines 720 and communicating jackpot increments (for example a fixed percentage of the amount bet) to the jackpot controller 150 which increments the current jackpot value 730.

The method 700 then involves determining 740 whether a jackpot event has occurred. As described above, this determination can be conducted separately at each gaming machine. Upon a jackpot event occurring, the gaming system determines a jackpot event value of the jackpot. This is the value which the jackpot can be won, if a jackpot winning event occurs. The method then determines whether a jackpot is won 750 and if a jackpot is won, the award is made 760. If the jackpot is not won, then the method involves setting a new prior jackpot value 770 based on the jackpot event value of the jackpot. That is, the prior value at step 710 is updated to display the jackpot event value as the new prior value. The method continues in this manner 700 until the jackpot is won at which point the jackpot will be reset. Accordingly, it will be appreciated that in order for the displayed jackpot value to be updated, a jackpot event needs to occur which awards the player an opportunity to win the jackpot and the player must also not win the jackpot. It will also be appreciated that when the jackpot is not won and the increase in the jackpot based on the amount accrued towards the jackpot since the last jackpot event is likely to result in a significant and noticeable increment to the amount displayed as the jackpot value. This represents a very different approach to a normal incrementing jackpots where the jackpot value increments in small amounts based on turnover such that individual increments are of little interest to players.

Figure 8:
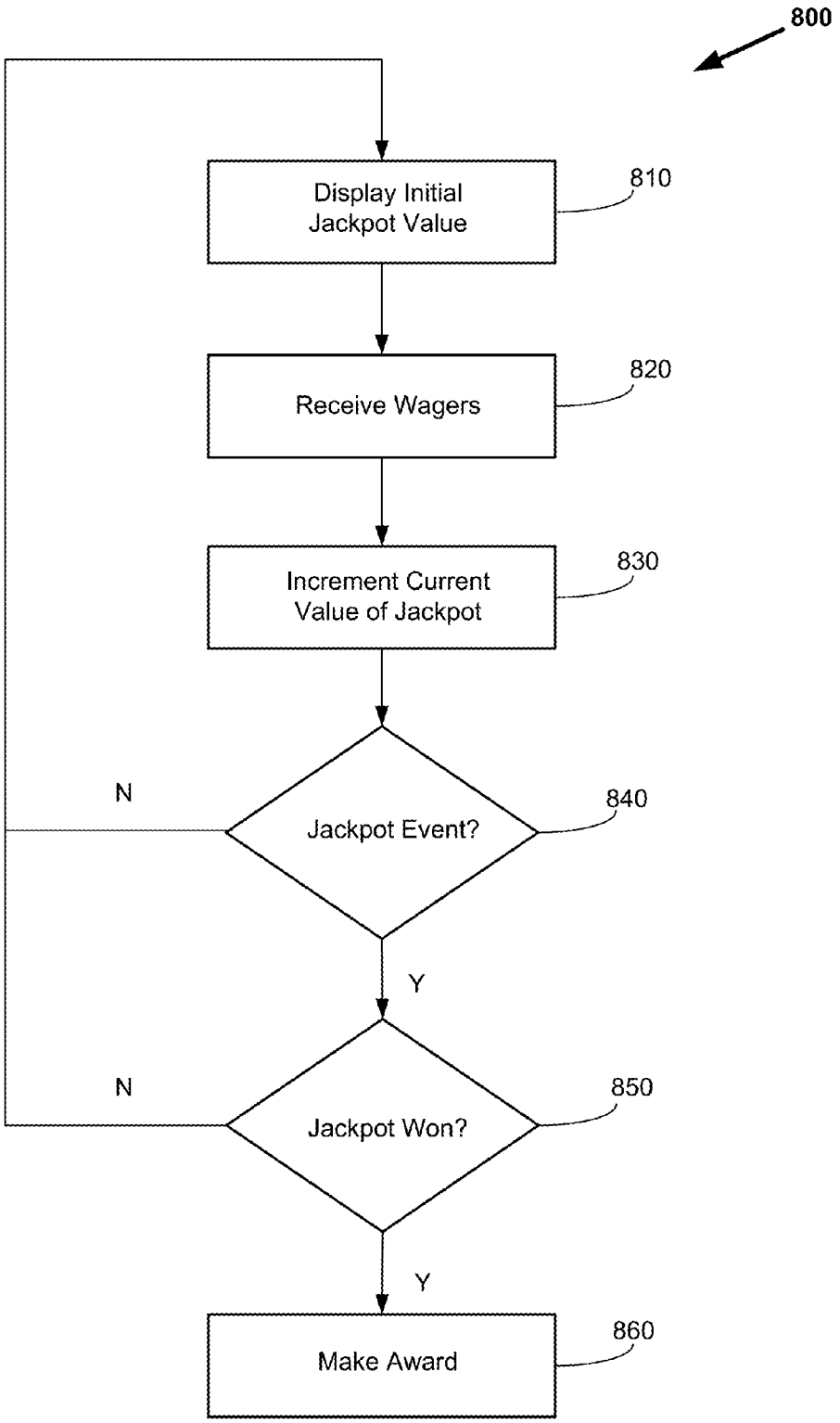
FIG. 8 is a flow chart of another embodiment.

An alternate embodiment is shown in FIG. 8. In this method 800, an initial jackpot value is displayed 810. Wagers are received 820 and the jackpot is incremented 830. It is determined whether there is a jackpot event 840 and upon there being a jackpot event, a jackpot event value of the jackpot is determined. If the jackpot is won, the jackpot event value is displayed as a winning amount on the gaming machine and an award is made 860 to the player. If the jackpot is not won 850, then the gaming machine continues to display the initial jackpot value 810. Accordingly, the jackpot value is never seen until it is won.

EXAMPLE 1

Before Awarding Jackpot

The Jackpot starts at $10. The Jackpot increment percentage is 1% and the turnover since the last jackpot trigger event has been $500.

The Jackpot meter would show $10 until the jackpot event triggers. The jackpot meter would then increment by 1%×$500=$5 to show $15. The player then plays for the jackpot (by any method e.g. a jackpot spin, pick a box, etc). If the player wins they are awarded $15, if player doesn't win then jackpot meter remains at $15 awaiting next jackpot trigger event.

EXAMPLE 2

After Winning Jackpot

The Jackpot starts at $10. The Jackpot increment percentage is 1% and the turnover since the last jackpot trigger event has been $500.

The Jackpot meter would show $10 until the jackpot event triggers. The player then plays for the jackpot (by any method e.g. a jackpot spin, pick a box, etc). If the player wins, the jackpot meter would then increment by 1%×$500=$5 to show $15 and they are awarded $15. If the player doesn't win then jackpot meter remains at $10 awaiting next jackpot trigger event.

Further aspects of the method will be apparent from the above description of the system. It will be appreciated that at least part of the method will be implemented electronically, for example, digitally by a processor executing program code such as in the above description of a game controller. In this respect, in the above description certain steps are described as being carried out by a processor of a gaming system, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art, will appreciate that program code provides a series of instructions executable by the processor.

It will be understood to persons skilled in the art of the invention that many modifications may be made without departing from the spirit and scope of the invention, in particular it will be apparent that certain features of embodiments of the invention can be employed to form further embodiments.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A method of gaming in a gaming system having a game controller, a memory, a display, and a gaming machine, the gaming machine comprising a credit input mechanism configured to accept a physical item associated with a monetary value for establishing a credit balance, the credit balance being increasable and decreasable, the method comprising:

displaying a prior jackpot value of a jackpot on the display of the gaming system, the prior jackpot value corresponding to a value of the jackpot when a previous jackpot trigger event occurred;

receiving wagers in accord with having established a credit balance at the gaming machine, the received wagers on one or more games playable at the gaming machine in the gaming system;

incrementing in the memory of the gaming system, via the game controller, a current value of the jackpot of the gaming system based on the wagers received at the gaming machine;

determining, via the game controller, a jackpot event value of the jackpot responsive to an occurrence of a jackpot event, the jackpot event value being the current value of the jackpot upon the occurrence of the jackpot event, and the jackpot event occurring independent of incrementing the jackpot;

upon the player winning the jackpot responsive to the jackpot event, making an award via the game controller to the player of the jackpot event value; and upon the player not winning the jackpot responsive to the jackpot event, setting the jackpot event value as a new prior jackpot value via the game controller and displaying the new prior jackpot value on the display of the gaming system until the next jackpot event, wherein the displaying of the prior jackpot value on the display of the gaming system remains unchanged, irrespective of the incrementing the current value of the jackpot in the memory of the gaming system based on the received wagers, until one of:

the occurrence of the jackpot event, or the player not winning the jackpot.

2. The method as claimed in claim 1, comprising conducting, by the game controller, a determination responsive to the jackpot event to determine whether to award the jackpot to the player.

3. The method as claimed in claim 2, comprising displaying the jackpot event value of the jackpot at the display of the gaming system before conducting the determination.

4. A method of gaming in a gaming system having a game controller, a memory, a display, and a gaming machine, the gaming machine comprising a credit input mechanism configured to accept a physical item associated with a monetary value for establishing a credit balance, the credit balance being increasable and decreasable, the method comprising:

displaying an initial jackpot value of a jackpot on the display of the gaming system;

receiving wagers in accord with having established a credit balance at the gaming machine, the received wagers on one or more games playable at the gaming machine in the gaming system;

incrementing in the memory of the gaming system, via the game controller, a current value of the jackpot pool based on the wagers received at the gaming machine;

determining, via the game controller, a jackpot event value of the jackpot responsive to an occurrence of a jackpot event, the jackpot event value being the current value of the jackpot upon the occurrence of the jackpot event, and the jackpot event occurring independent of incrementing the jackpot;

upon the player winning the jackpot responsive to the jackpot event, making an award via the game controller to the player of the jackpot event value of the jackpot pool; and upon the player not winning the jackpot responsive to the jackpot event, continuing to display the initial jackpot value at the display of the gaming system, irrespective of the incrementing the current value of the jackpot in the memory of the gaming system based on the received wagers, until the player winning the jackpot.

5. The method as claimed in claim 4, comprising conducting, by the game controller, a determination responsive to the jackpot event to determine whether to award the jackpot to the player.

6. A gaming system comprising:

a display configured to display a prior jackpot value of a jackpot corresponding to a value of the jackpot when a previous jackpot trigger event occurred;

a gaming machine comprising a credit input mechanism configured to accept a physical item associated with a monetary value for establishing a credit balance, the credit balance being increasable and decreasable, the gaming machine operable to receive wagers in accord with having established a credit balance at the gaming machine, the received wagers on one or more games playable at the gaming machine in the gaming system;

a memory configured to store a current value of the jackpot; and a game controller configured to:

increment a current value of the jackpot in the memory of the gaming system based on the wagers received at the gaming machine;

determine a jackpot event value of the jackpot responsive to an occurrence of a jackpot event, the jackpot event value being the current value of the jackpot upon the occurrence of the jackpot event, and the jackpot event occurring independent of incrementing the jackpot;

upon the player winning the jackpot responsive to the jackpot event, make an award to the player of the jackpot event value; and upon the player not winning the jackpot responsive to the jackpot event, set the jackpot event value as a new prior jackpot value and control the display to display the new prior jackpot value until the next jackpot event, wherein the display of the prior jackpot value on the display of the gaming system remains unchanged, irrespective of the incrementing the current value of the jackpot in the memory of the gaming system based on the received wagers, until one of:

the occurrence of the jackpot event, or the player not winning the jackpot.

7. The gaming system as claimed in claim 6, wherein the game controller is configured to conduct a determination responsive to the jackpot event to determine whether to award the jackpot to the player.

8. The gaming system as claimed in claim 7, wherein the game controller is configured to control the display to display the jackpot event value of the jackpot before conducting the determination.

9. The gaming system as claimed in claim 6, wherein the gaming machine is a standalone gaming machine, and wherein the display, the memory, and the gaming controller is disposed in the standalone gaming machine.

10. The gaming system as claimed in claim 6, wherein the gaming system comprises a plurality of the gaming machine, and wherein the plurality of the gaming machine are linked to the game controller.

11. A gaming system comprising:

a display configured to display an initial jackpot value of a jackpot;

a gaming machine comprising a credit input mechanism configured to accept a physical item associated with a monetary value for establishing a credit balance, the credit balance being increasable and decreasable, the gaming machine operable to receive wagers in accord with having established a credit balance at the gaming machine, the received wagers on one or more games playable at the gaming machine in the gaming system;

a memory configured to store a current value of the jackpot; and a game controller configured to:

increment a current value of the jackpot in the memory of the gaming system based on the wagers received at the gaming machine;

determine a jackpot event value of the jackpot responsive to an occurrence of a jackpot event, the jackpot event value being the current value of the jackpot upon the occurrence of the jackpot event, and the jackpot event occurring independent of incrementing the jackpot;

upon the player winning the jackpot responsive to the jackpot event, make an award to the player of the jackpot event value of the jackpot pool; and upon the player not winning the jackpot responsive to the jackpot event, control the display to continue to display the initial jackpot value, irrespective of the incrementing the current value of the jackpot in the memory of the gaming system based on the received wagers, until the player winning the jackpot.

12. The gaming system as claimed in claim 11, wherein the game controller is configured to conduct a determination responsive to the jackpot event to determine whether to award the jackpot to the player.

13. The gaming system as claimed in claim 11, wherein the gaming machine is a standalone gaming machine, and wherein the display, the memory, and the gaming controller is disposed in the standalone gaming machine.

14. The gaming system as claimed in claim 11, wherein the gaming system comprises a plurality of the gaming machine linked to the game controller.

15. The method as claimed in claim 1, further comprising executing, by the game controller, a computer program code.

16. The method as claimed in claim 15, further comprising storing said computer program code in a tangible computer readable medium.

* * * * *